US009694475B2

(12) United States Patent
Dowd et al.

(10) Patent No.: US 9,694,475 B2
(45) Date of Patent: Jul. 4, 2017

(54) CLAMP

(71) Applicants: Peter Christopher Dowd, Hamilton (NZ); Stefan van Woerden, Hamilton (NZ)

(72) Inventors: Peter Christopher Dowd, Hamilton (NZ); Stefan van Woerden, Hamilton (NZ)

( * ) Notice: Subject to any disclaimer, the term of this patent is extended or adjusted under 35 U.S.C. 154(b) by 307 days.

(21) Appl. No.: 14/453,499

(22) Filed: Aug. 6, 2014

(65) Prior Publication Data

US 2015/0042027 A1 Feb. 12, 2015

(30) Foreign Application Priority Data

Aug. 6, 2013 (NZ) ..... 614008

(51) Int. Cl.

| | |
|---|---|
| ***B25B 1/20*** | (2006.01) |
| ***B25B 5/04*** | (2006.01) |
| ***B25B 1/04*** | (2006.01) |
| ***B25B 5/00*** | (2006.01) |
| ***B25B 5/12*** | (2006.01) |
| ***B25B 5/14*** | (2006.01) |
| ***B25B 5/16*** | (2006.01) |
| *B21B 1/20* | (2006.01) |

(Continued)

(52) U.S. Cl.

CPC ..... *B25B 1/20* (2013.01); *B25B 1/04* (2013.01); *B25B 5/006* (2013.01); *B25B 5/04* (2013.01); *B25B 5/12* (2013.01); *B25B 5/14* (2013.01); *B25B 5/163* (2013.01); *B21B 1/20* (2013.01); *B25B 1/2452* (2013.01); *B25B 5/06* (2013.01)

(58) Field of Classification Search

CPC .. B25B 5/006; B25B 1/24; B25B 1/20; B25B 1/04; B25B 5/04; B25B 1/2452; B25B 5/06; B25B 1/22; B25B 5/14; B25B 5/12; B25B 5/163

USPC ... 269/90, 257, 150, 161, 43, 156, 239, 128, 269/270, 241

See application file for complete search history.

(56) References Cited

U.S. PATENT DOCUMENTS 1,660,329 A * 2/1928 Fleming ..... B25B 1/04 269/128
2,242,080 A * 5/1941 Kurzina, Jr. ..... B25B 1/20 269/270

(Continued)

FOREIGN PATENT DOCUMENTS

CA 2751508 A1 * 8/2011

*Primary Examiner* — Larry E Waggle, Jr.
*Assistant Examiner* — Mahdi H Nejad
(74) *Attorney, Agent, or Firm* — Weiss & Moy; Jeffrey D. Moy

(57) ABSTRACT

A clamp suitable for clamping a handle from which a blade extends or a pair of scissors when the blade is being tested or sharpened. The clamp includes a first jaw, a second jaw and a releasable lock if the form of a latch and teeth. At least one of the jaws are able to swing with respect to the other jaw through a hinge mechanism. The first jaw comprises two outer padded parts and a central padded part. The outer and central padded parts are aligned. The central padded part is recessed such that a curved handle or pair of scissors can lay against all three padded parts when clamped. If a straight handle is clamped, the handle only contacts the outer padded parts. The second jaw also comprises padded parts which are inwardly angled for gripping.

13 Claims, 4 Drawing Sheets

(51) Int. Cl.
*B25B 1/24* (2006.01)
*B25B 5/06* (2006.01)

(56) References Cited

U.S. PATENT DOCUMENTS

| | | | | | |
|---|---|---|---|---|---|
| 4,391,458 | A * | 7/1983 | Blakeley | F16L 41/12 | 285/112 |
| 6,152,435 | A * | 11/2000 | Snell | B25B 1/2452 | 269/268 |
| 6,431,534 | B1 * | 8/2002 | Orosz | B25B 5/101 | 269/249 |
| 2004/0232608 | A1 * | 11/2004 | Wong | B25B 5/006 | 269/249 |
| 2012/0227221 | A1 * | 9/2012 | Whitaker | A61M 39/1011 | 24/459 |

* cited by examiner

CLAMP

RELATED APPLICATIONS

The present utility patent application is related and claims priority from New Zealand application 614008 filed Aug. 6, 2013.

FIELD OF INVENTION

This invention relates to a clamp. A preferred form of the invention relates to a clamp for clamping a handle with a cutting implement while its blade is being sharpened or tested for sharpness, although it should be understood that the invention is not limited to this.

BACKGROUND

Clamps are well known. One disadvantage of some clamps is that they are less than convenient to use. It is accordingly an object of a preferred form of the invention to go at least some way towards addressing this problem, or to at least provide the public with a useful choice.

SUMMARY OF THE INVENTION

According to one aspect of the invention there is provided a clamp formed so as to be suitable for clamping a handle from which a blade extends while the blade is being tested or sharpened, the clamp having:

a first jaw and a second jaw, at least one of which is able to swing with respect to the other in a clamping action, and means to releasably lock the jaws in a clamping disposition, the first jaw having two outer padded parts and a central padded part, all of which are aligned except that the central padded part is recessed such that a curved handle of a pair of scissors can lay against all three padded parts when the scissors are held by the clamp, and wherein when the clamp is used with a knife having a straight handle such handle is held against the outer padded parts without contacting the central padded part.

Preferably the second jaw has padded parts adapted for gripping the handle.

Preferably the padded parts have inwardly angled sides adapted for gripping the handle.

Preferably the padded parts have ridges to facilitate gripping.

Preferably, the first jaw has a substantially H-shaped cross section.

Preferably the clamp has a hinge mechanism which enables the second jaw to swing with respect to the first jaw.

Preferably the hinge mechanism is spring loaded.

Preferably the clamp has an angle limiter which limits an extent to which the clamp can open.

Preferably the means to releasably lock the clamp comprises a latch and teeth and wherein the latch can engage the teeth to lock the jaws.

Preferably the second jaw has a notch adapted to receive a handle hook from a pair of scissors.

Preferably one of the jaws has a protruding overhang to prevent rotation of the handle when in use.

Preferably the clamp has apertures and projections which enable it to be attached to a blade testing or sharpening machine.

Preferably the clamp forms part of a blade sharpness testing machine or a blade sharpening machine.

BRIEF DESCRIPTION OF DRAWINGS

Some preferred embodiments of the invention will now be described by way of example and with reference to the accompanying drawings, of which.

DETAILED DESCRIPTION

Figure 1:
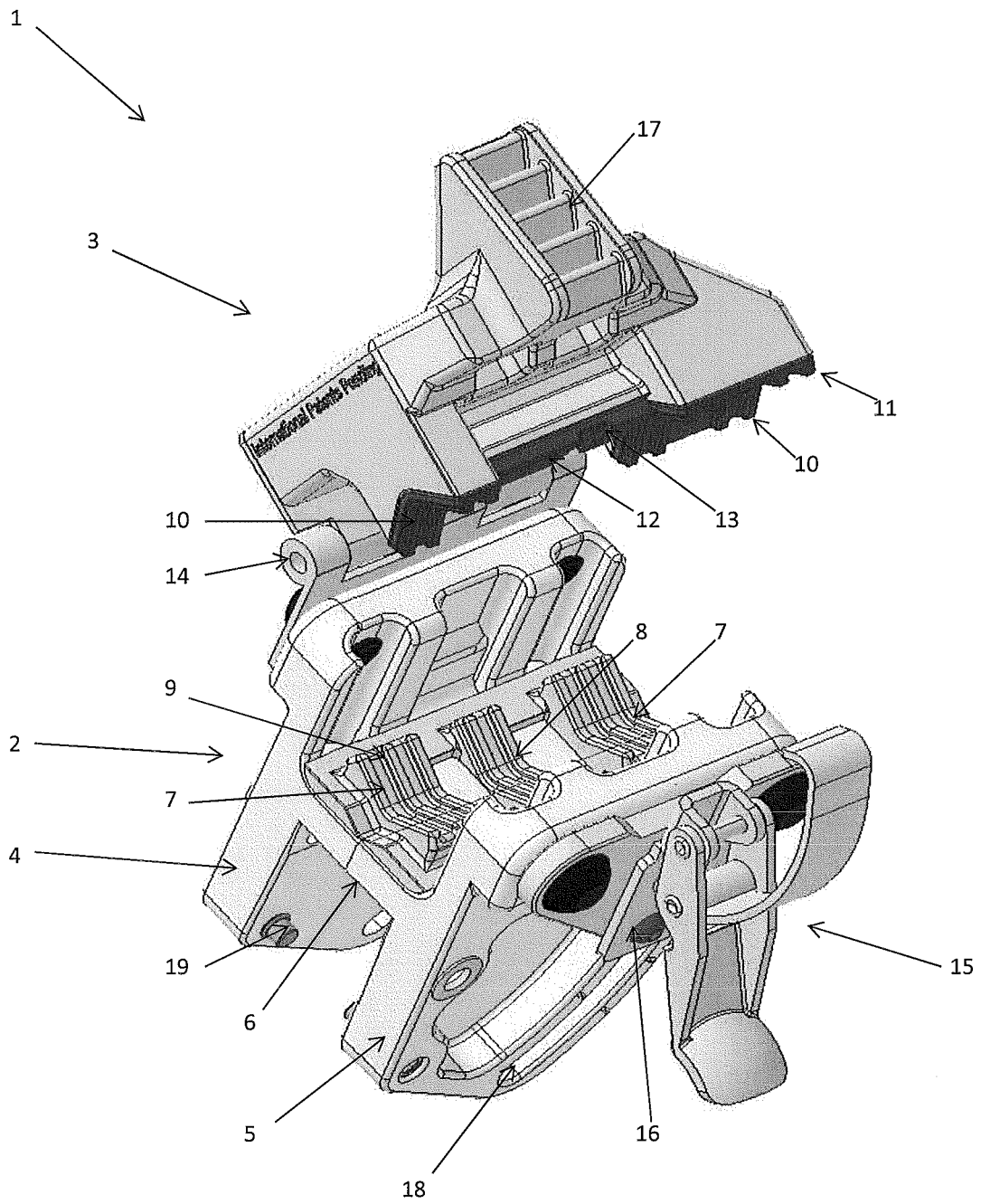
FIG. 1 is a perspective view illustrating a clamp.

Referring to FIG. 1, the clamp 1 has a first jaw 2 and a second jaw 3. The jaws 2 and 3 can be largely made from plastic or any other suitable material. As seen in FIG. 1 the first jaw 2 has substantially H-shaped cross section incorporating two sides 4 and 5 and a cross part 6. The first jaw 2 has two outer padded parts 7 and a central padded part 8. The padded parts 7 and 8 are located on the cross part 6. The padded parts 7 and 8 are all aligned except the central padded part 8 is recessed. The padded parts 7 and 8 have inwardly angled sides which aid with the gripping and centring of a handle. The padded parts 7 and 8 have ridges 9 on them which facilitate the gripping action and help prevent forward and backward movement of a handle (not shown) when in use. The padded parts 7 and 8 can be made from rubber or any other suitable material. While the padded parts 7 and 8 are shown as separate features in alternative embodiments of the invention they may simply be different zones of a unitary pad.

The second jaw 3 also has two outer padded parts 10 which have inwardly angled sides which aid with gripping and centring a handle (not shown). The outer padded parts 10 have ridges on them 11. The ridges 11 facilitate the gripping action and help prevent forward and backward movement of a handle (not shown). The second jaw 3 also has a straight padded part 12 which contains a notch 13 in it. The notch 13 allows the clamp to be used to clamp scissors which have a handle hook as the hook engages with the notch. The padded parts 10 and 12 can be made from rubber or any other suitable material.

The first jaw 2 and the second jaw 3 are connected by a hinge mechanism 14 which enables the second jaw 3 to swing with respect to the first jaw 2. The hinge mechanism 14 can be spring loaded and 14 allows easy opening of the second jaw 2. The clamp 1 also has an adjustable latch 15 which is attached via a latch bracket 16 to the first jaw 2. The latch 15 can be made from metal such as steel, or any other suitable material. The second jaw 3 has teeth 17 which are adapted to engage with the latch 15 in a locking relationship. In some embodiments of the invention the latch may be mounted on the second jaw 3 rather than the first jaw 2 and in that case the teeth may be positioned on the first jaw 2.

The lower sides 4 and 5 of the first jaw 3 contain apertures 18 and projections 19 which allow the clamp to be attached to a blade sharpness testing machine or a blade sharpening machine (not shown).

In use the second jaw 3 is swung to an open disposition so that a handle of a blade (not shown) can be placed on the padded parts 7 and 8 of the first jaw 2. If a blade with a straight handle is used the handle contacts the outer padded parts 7 without contacting the recessed central padded part 8. However, if a blade with a curved handle such as a pair of scissors is used then the handle can lay against all three padded parts 7 and 8, that is because the central curve of the handle extends down to the recessed padded part 8. Once the handle has been placed on the padded parts 7 and 8 the second jaw 3 is swung down such that the padded parts of both jaws 7, 8, 10 and 12 contact the handle in a clamping action. The latch 15 on the first jaw 2 is then engaged into a locking relationship with the teeth 17 on the second jaw 3 and the jaws 2 and 3 are locked in place. To remove the handle the latch 15 is released and the second jaw 3 is swung open.

Figure 2:
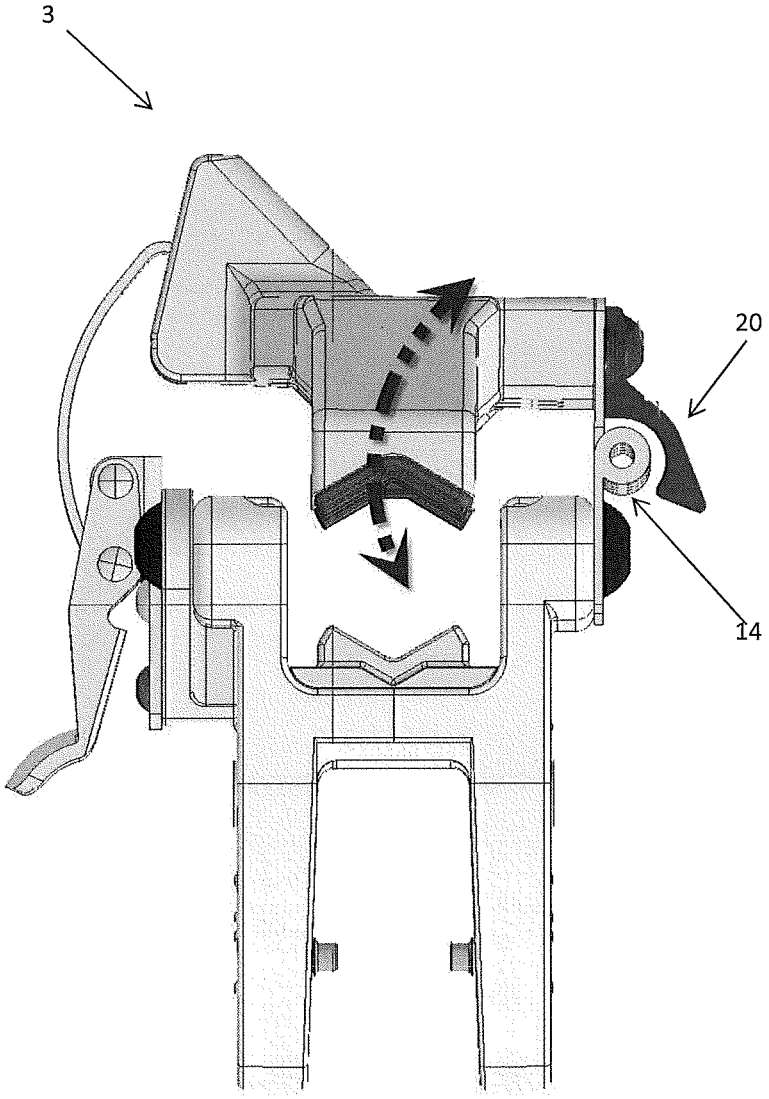
FIG. 2 is a front view illustrating the clamp.

As shown in FIG. 2 the hinge mechanism 14 has an angle limiter 20 attached to it which limits the extent to which the second jaw 3 can be opened.

Figure 3:
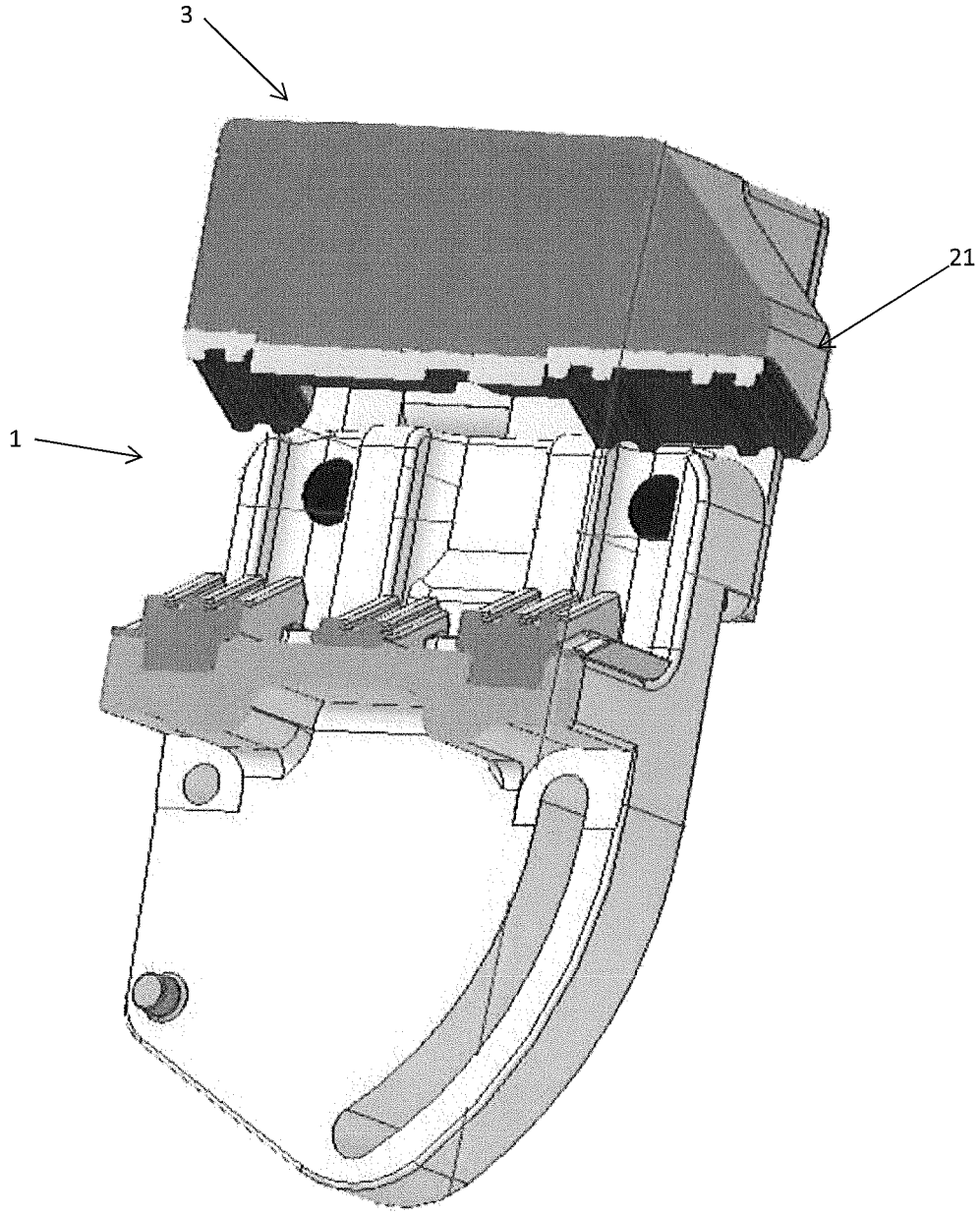
FIG. 3 is side cross sectional view illustrating the clamp.

As indicated in FIG. 3 the second jaw 3 has a protruding overhang 21 which is adapted to prevent rotation of scissors when these are being held by the clamp 1.

Figure 4:
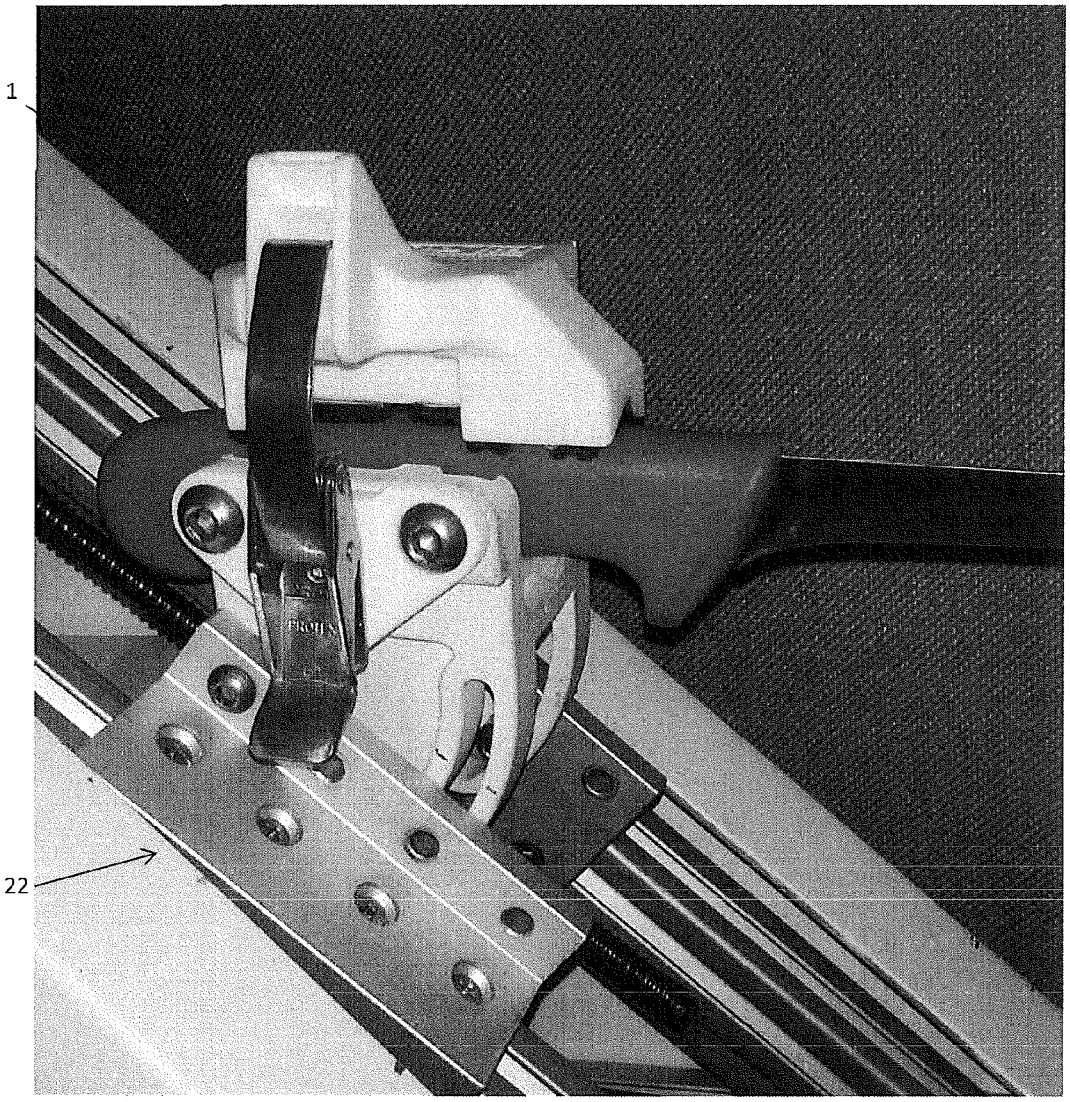
FIG. 4 is a side view illustrating the clamp in use.

FIG. 4 illustrates the clamp 1 when in use clamping a handle of a knife and wherein the clamp is part of a blade sharpness testing machine 22, although the clamp can be put to a wide variety of other uses While some preferred embodiments of the invention have been described by way of example it should be appreciated that modifications and improvements can occur without departing from the scope of the following claims.

We claim:

1. A clamp in a blade testing or sharpening machine, the clamp for clamping a handle from which a blade extends while the blade is being tested or sharpened, the clamp having:

a first jaw and a second jaw, at least one of which is able to swing with respect to the other in a clamping action, and a releasable lock which is able to lock the jaws in a clamping disposition, the first jaw having two outer padded parts and a central padded part, each of the padded parts having inwardly angled sides, all the padded parts are aligned except that the central padded part is recessed, wherein when clamping a curved handle of a pair of scissors, a blade of which is to be tested or sharpened by the blade testing or sharpening machine, the curved handle can lay against all three padded parts and when clamping a knife having a straight handle, a blade of which is to be tested or sharpened by the blade testing or sharpening machine, the straight handle is held against the outer padded parts without contacting the central padded part; and wherein after the blade testing or sharpening machine has completed a test on the blade, the jaws can be unlocked from the clamping disposition, the handle can be removed from the clamp, and another handle from which a blade extends can be placed in the clamp.

2. The clamp according to claim 1, wherein the second jaw has padded parts adapted for gripping the handle.

3. The clamp according to claim 1, wherein the inwardly angled sides of the padded parts are adapted for gripping the handle.

4. The clamp according to claim 1, wherein the padded parts have ridges to facilitate gripping.

5. The clamp according to claim 1, wherein the second jaw has padded parts adapted for gripping the handle, each padded part of the second jaw has inwardly angled sides adapted for gripping the handle, each padded parts of the first and second jaws having ridges to facilitate gripping and the first jaw has a substantially H-shaped cross section.

6. The clamp according to claim 1, wherein the second jaw has padded parts adapted for gripping the handle, each padded part of the second jaw has inwardly angled sides adapted for gripping the handle, each padded part of the first and second jaws having ridges to facilitate gripping, the first jaw has a substantially H-shaped cross section and the clamp has a hinge mechanism which enables the second jaw to swing with respect to the first jaw.

7. The clamp according to claim 6, wherein the hinge mechanism is spring loaded.

8. The clamp according to claim 1, wherein the clamp has an angle limiter which limits an extent to which the clamp can open.

9. The clamp according to claim 1, wherein the releasable lock comprises a latch and teeth and wherein the latch can engage the teeth to lock the jaws.

10. The clamp according to claim 1, wherein the second jaw has a notch adapted to receive a handle hook from the pair of scissors.

11. The clamp according to claim 1, wherein one of the jaws has a protruding overhang to prevent rotation of the handle when in use.

12. The clamp according to claim 1, having apertures and projections which enable it to be attached to the blade testing or sharpening machine.

13. A clamp for clamping a handle from which a blade extends while the blade is being tested or sharpened, the clamp having:

a first jaw and a second jaw, at least one of which is able to swing with respect to the other in a clamping action, and a releasable lock which is able to lock the jaws in a clamping disposition, the first jaw having two outer padded parts and a central padded part, each padded part having inwardly angled sides, all the padded parts are aligned except that the central padded part is recessed;

the first jaw having a substantially H-shaped cross-section;

the second jaw having padded parts for gripping the handle, each padded part having inwardly angled sides;

one of the first and second jaws having a protruding overhang to prevent rotation of the handle when in use;

wherein when clamping a curved handle of a pair of scissors, a blade of which is to be tested or sharpened by a blade testing or sharpening machine, the curved handle can lay against all three padded parts of the first jaw, and when clamping a knife having a straight handle, a blade of which is to be tested or sharpened by the blade testing or sharpening machine, the straight handle is held against the outer padded parts without contacting the central padded part; and the clamp having apertures and projections which enable it to be attached to the blade testing or sharpening machine.

* * * * *